United States Patent [19]

Crowe et al.

[11] Patent Number: 4,676,429

[45] Date of Patent: Jun. 30, 1987

[54] OCTAGONAL TRAY WITH VERTICAL STACKING POSTS AND STABILIZED CORNER PANELS

[75] Inventors: Stephen O. Crowe; Jeffrey D. Harper, both of Springhill, La.; Woody B. Wilson, Oxford, Miss.

[73] Assignee: International Paper Company, New York, N.Y.

[21] Appl. No.: 820,293

[22] Filed: Jan. 21, 1986

[51] Int. Cl.[4] ..... B65D 5/22; B65D 5/46

[52] U.S. Cl. ..... 229/109; 229/52 B; 229/177; 229/178; 229/179; 229/DIG. 11; 229/915

[58] Field of Search ..... 229/34 R, DIG. 11, 34 B, 229/32, 52 B, 41 C, 41 D, 109, 177, 178, 179, 915

[56] References Cited

U.S. PATENT DOCUMENTS

| | | | |
|---|---|---|---|
| 882,688 | 4/1908 | Janicke . | |
| 1,160,990 | 10/1915 | Obenchain et al. . | |
| 2,366,304 | 1/1945 | Williams et al. | 229/52 |
| 2,522,598 | 9/1950 | Blandford | 229/35 |
| 2,660,363 | 11/1953 | Trickett, Jr. et al. | 229/35 |
| 2,990,995 | 7/1961 | Wessel | 229/178 |
| 3,116,867 | 1/1964 | Morgan | 229/34 R |
| 3,258,188 | 6/1966 | Houston | 229/34 R |
| 3,276,660 | 10/1966 | Vesak | 229/178 |
| 3,361,323 | 1/1968 | Adams et al. | 229/23 |
| 3,547,337 | 12/1970 | Pisarczuk | 229/34 |
| 3,764,059 | 10/1973 | Knowles | 229/34 R |
| 3,883,067 | 5/1975 | McGlynn et al. | 229/31 |
| 3,899,121 | 8/1975 | Herbetko | 229/34 R |
| 3,917,156 | 11/1975 | Baudet | 229/32 |
| 3,918,630 | 11/1975 | Meyers | 229/35 |
| 4,119,265 | 10/1978 | Dlugopolski | 229/31 R |
| 4,236,740 | 12/1980 | Sorenson et al. | 229/36 |
| 4,408,710 | 10/1983 | Aust | 229/52 B |
| 4,417,686 | 11/1983 | Wozniacki | 229/52 B |

FOREIGN PATENT DOCUMENTS

| | | | |
|---|---|---|---|
| 943515 | 3/1974 | Canada | 229/34 R |
| 1320926 | 2/1963 | France | 229/41 C |
| 1494762 | 8/1967 | France | 229/34 R |
| 2336042 | 7/1977 | France | 229/109 |
| 2423404 | 12/1979 | France | 229/34 R |
| 732410 | 6/1955 | United Kingdom | 229/52 B |
| 1563391 | 3/1980 | United Kingdom | 229/34 R |

*Primary Examiner*—Stephen Marcus
*Assistant Examiner*—Gary E. Elkins
*Attorney, Agent, or Firm*—Walt Thomas Zielinski

[57] ABSTRACT

An octagonal tray and one-piece blank for forming it. The tray is formed from corrugated paperboard and is provided on at least its interior bottom and wall surfaces with a wax coating. The tray includes vertically disposed posts at its end walls, the posts increasing the vertical stacking strength of the tray and also reducing the requirement that the trays be accurately vertically aligned when stacked one on top of the other. The tray is manually erected by folding along hinge or fold axes formed in the blank. Crushed ice is placed among and on fish or poultry within the tray for example, with the tray then being lidded for shipment.

5 Claims, 2 Drawing Figures

OCTAGONAL TRAY WITH VERTICAL STACKING POSTS AND STABILIZED CORNER PANELS

BACKGROUND OF THE INVENTION

This invention rlates to containers and more particularly to containers formed from stiff, resilient and bendable sheet material, such as corrugated paperboard. The invention also relates to a one-piece blank, such as of corrugated paperboard, for making the container tray of this invention.

The invention exhibits particular utility in the packaging of poultry and fish, wherein poultry or fish is placed into a tray, along with crushed ice. The tray is filled with the poultry or fish and the crushed ice, a top cover is placed on the tray to form a complete container, with the container then being ready for stacking and shipment. Conventionally, such trays are formed from one or more pieces of corrugated paperboard and are coated on at least their interior surface with wax. It is clearly desirable to have available a tray, preferably formed from a single blank, which may be readily erected by folding along pre-scored hinged lines, in order that personnel at a processing point may readily form the erected trays, as they are needed, from a supply of flat blanks.

Somewhat similar tray constructions are known in the prior art, as for example that shown in U.S. Pat. No. 4,417,686 issued to Wozniacki. It has been found that octagonal trays exhibit greater strength than rectangular trays and the practice of this invention permits the use of an octagonal tray fashioned from a single blank.

SUMMARY OF THE INVENTION

According to the practice of this invention a readily erectable tray may be formed from a single blank by suitably cutting and scoring to provide hinge lines in the blank. The resultant tray is octagonal, with four of the eight sides being of relatively narrow width. One feature of the tray of this invention resides in a construction which permits the narrow width sides of the tray to bear or abut, at their bottom edges against corresponding edge surfaces on a bottom forming panel, so that displacement forces, which may accidently be placed on the assembled container tray of this invention will not cause the narrow width panels to move from their intended orientation or position. According to another feature of the present invention the stacking strength of container trays of this invention is materially increased. This is done by the provision of post members at both ends of the tray. In addition to increasing the vertical stacking strength, the presence of the post members makes less critical the necessity that a plurality of container trays be exactly in vertical alignment for stacking. It has been found that the stacking strength enjoued by the practice of this invention is approximately 20 to 30% greater than the stacking or compressive strength of similar containers. The tray is readily erectable by hand and does not require the use of relatively expensive machinery to set it up or erect it.

DETAILED DESCRIPTION OF THE INVENTION

Figure 1:
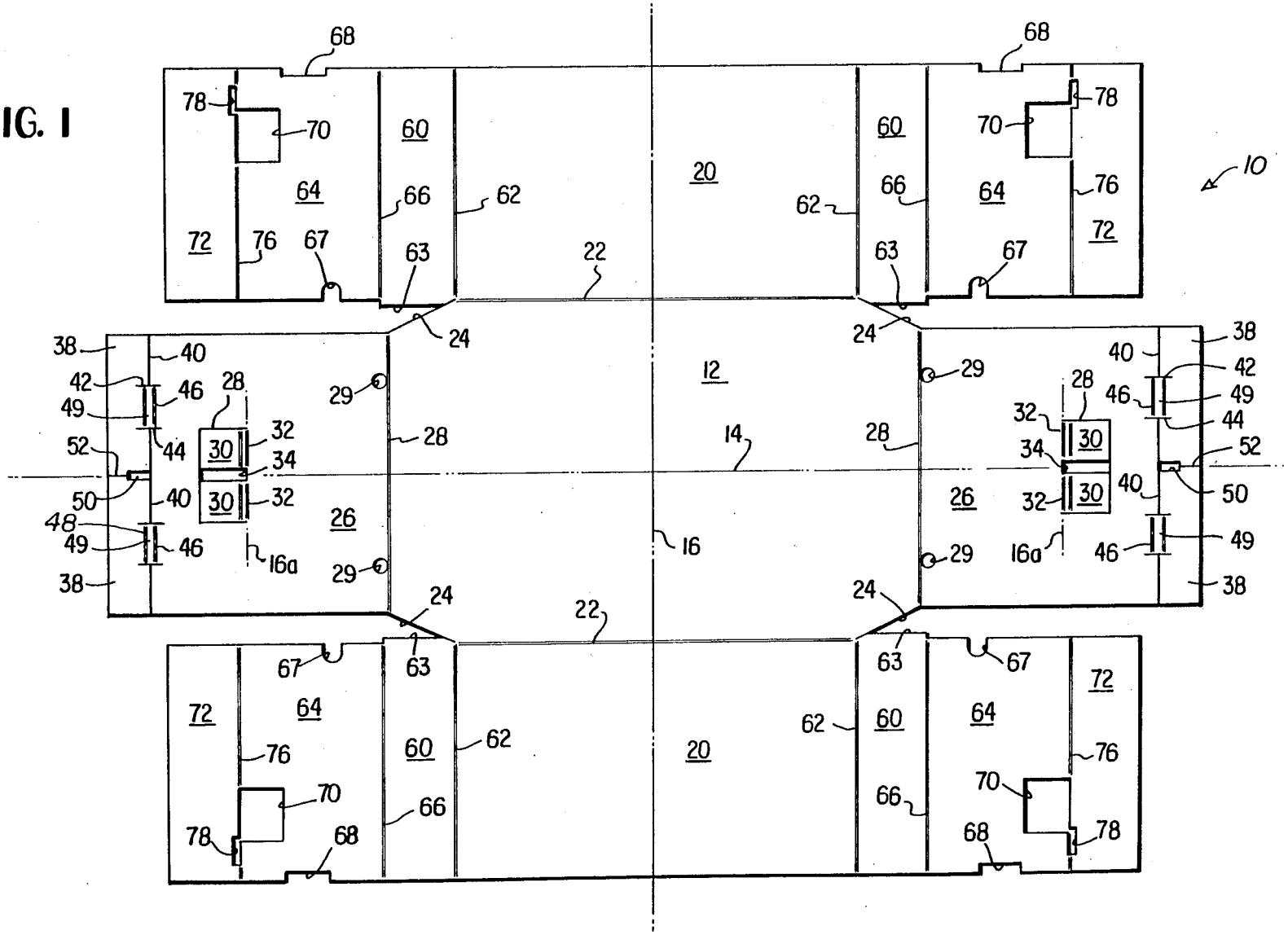
FIG. 1 is a plan view of the one-piece blank of this invention.

Referring now to FIG. 1 of the drawings, the numeral 10 denotes generally the blank of this invention and is formed from corrugated paperboard having a wax coating on at least that surface which will be the inner surface of a tray formed by erecting the blank. The numeral 12 denotes a bottom forming panel, generally rectangular in shape, while the numeral 14 denotes generally a longitudinal axis. The numeral 16 denotes a generally transverse axis, with axes 14 and 16 being illustrated for purposes of reference and in the description of the invention. The numeral 20 denotes either one of two side forming panels which are attached by hinge lines 22 to bottom forming panel 12. The numeral 24 denotes any one of four corner cuts at each corner of panel 12.

The numeral 26 denotes either one of two primary end forming panels, with each being provided with a handle defining opening 28 defined by hinged handle flaps 30 each of which is bendable about a respective hinge line 32, with hinge lines 32 defining another transverse axis denoted by the numeral **16*a*. The numeral 34 denotes a space between handle flaps 30. The numeral 38 denotes either one of two locking panels. The numeral 40 denotes transverse cut lines which terminate at longitudinal cut lines 42 and 44. The numerals 46 and 48 denote spaced transversely extending hinge lines. Hinge lines 46 and 48, togeter with cut lines 42 and 44 define a hinge panel 49 which effectively joins each locking panel 38 to its respective primary end forming panel 26. The numeral 50 denotes a space between centermost end portions of locking panels 38, while the numeral 52 denotes a locking tab associated with each locking panel 38**.

The numeral 60 denotes any one of four corner or side panels, the latter being hinged along hinge lines 62 to a respective side forming panel 20. The numeral 63 denotes an extension of each corner panel 60, it being observed that with extension 63, the width of the corner panels 60 is greater than that of panels 20 and 64, the latter now to be described. The numeral 64 denotes an auxiliary end forming panel having at one edge a cut-out 68 and an aperture 67 at its other edge. The numeral 70 denotes a handle defining cut-out which borders on hinge axis 76, the latter joining post panel 72 to a respective auxiliary end forming panel 64. The numeral 78 denotes an aperture in post panel 78 bordering on a hinge line 76.

The reader will observe that the blank 10 exhibits mirror symmetry about both longitudinal axis 14 and transverse axis 16. Accordingly, a description of the numbered portions of the blank will suffice for a full description.

Figure 2:
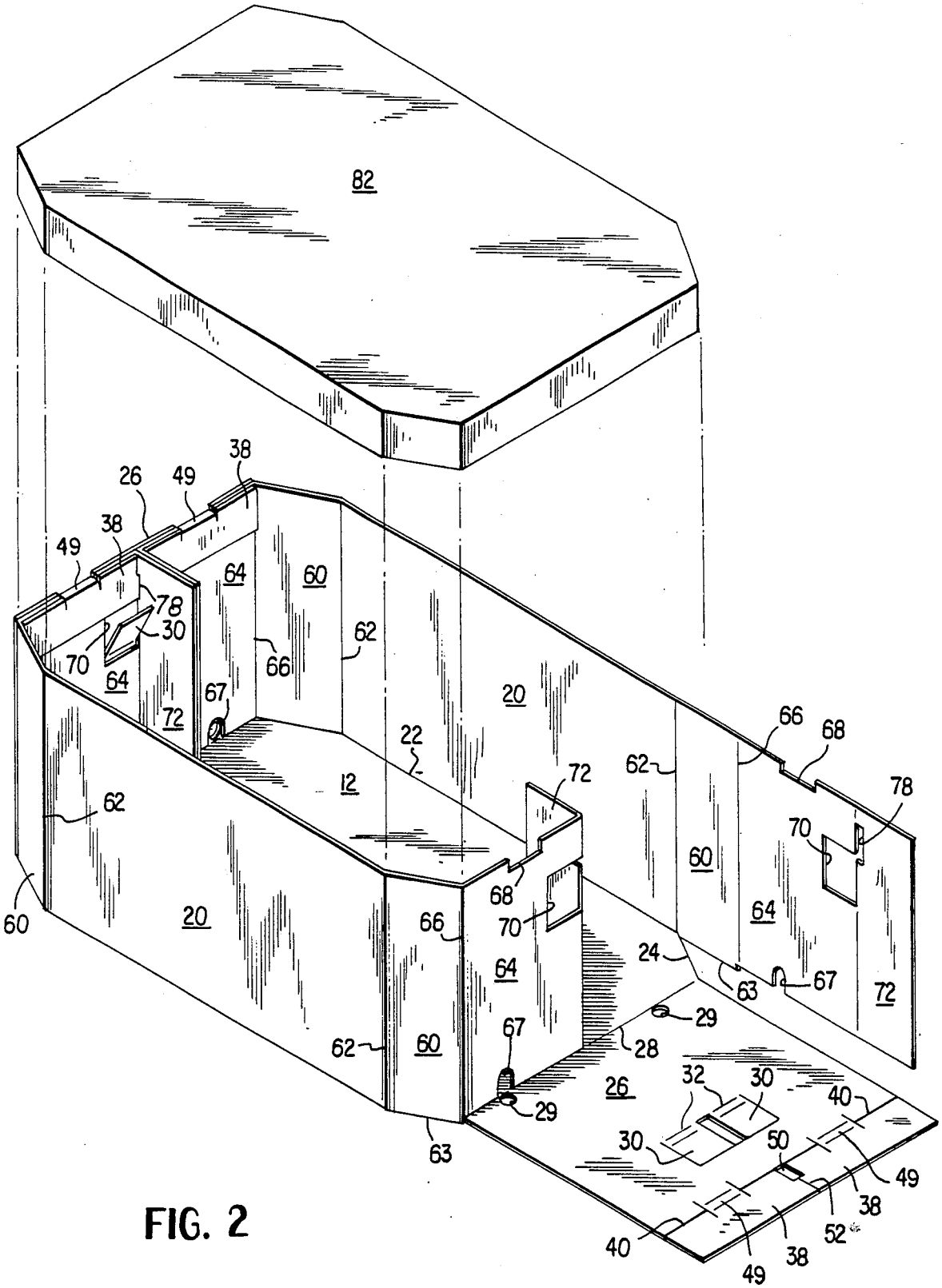
FIG. 2 is a perspective view of a tray formed by erecting the blank of this invention, the view showing one end of the tray completely erected and showing the other end of the tray only partially erected.

Referring now to FIG. 2 of the drawings, the blank is shown in its erected configuration. To assemble the tray, panels 20, 60, 64 and 72 are folded along a respective hinge line 22 so that panels 20 are perpendicular to panel 12. Post forming panels 72 are brought together, in the indicated configuration, and then primary end forming panels 26 are hinged 90 degrees to bear against panels 64. It will be observed that panels 64 are coplanar. Locking panels 38 are now bent down, hinging about hinge panels 49, with locking tabs 52 being inserted into corresponding apertures 78. Next, handle panels 30 are pushed inwardly towards the interior, to thereby sandwich the post panels 72, the latter of which are in abutting, surface to surface relationship with each other. A similarly configured top 82 is adapted to be placed over the tray to close it.

The reader will observe that portions 63 of corner panel 60 are in bearing contact with the edge of cuts 24. This bearing contact ensures that accidental displacement forces which may be directed against the container during shipment will not change the desired angle of the corner panels with respect to the container. Aligned apertures 29 and 67 permit drainage of liquid from the container when it is filled with poultry or fish and crushed ice.

It will be understood that the numerals which appear in the claims are intended only to be an aid to readily identifying that which is claimed, as a convenience to the reader, and not as limiting the scope of the claims.

What is claimed is:

1. A one-piece blank of stiff, resilient and foldable sheet material, such as corrugated paperboard, the blank being adapted to be folded into a tray having bottom, side, and end panels the blank including a bottom forming panel (12) of generally rectangular shape, the blank also having primary end forming panels (26) each foldably connected to an end of the bottom forming panel along a fold line, side forming panels each foldably connected to a side of the bottom forming panel along a fold line, each end of each side forming panel foldably joined to a corner forming panel (60), an auxiliary end forming panel (64) foldably joined to each corner forming panel, each auxiliary end forming panel (64) having a foldable post forming panel (72) at one end, the post forming panels being adapted to be placed together in surface contact with each other and to extend inwardly of the tray erected from the blank, the primary end forming panels (26) being narrower than the bottom forming panel (12) to thereby define a slanted cut (24) at each corner of the bottom forming panel, a straight, lower forming edge of each corner panel being offset from the fold lines connecting the side forming panels to the bottom forming panel, by an amount equal to the thickness of the blank, along a majority of its length whereby the lower forming edge (63) of each corner panel, when the blank is erected, abuts against a respective one of said bottom panel (12) slanted cuts (24), whereby the lower surface of the tray is flat and whereby the corner panels are maintained in position by contact with the edges of the slanted cuts of the bottom panel.

2. The one-piece blank of claim 1 wherein each primary end forming panel (26) is provided with a pair of transversely spaced handle flaps (30) hinged about a transverse axis, and wherein each auxiliary end forming panel (64) is provided with a handle defining cut-out (70), one side thereof bounding on the fold between its respective post forming (72) and auxiliary end forming (64) panels, whereby the handle flaps (30) pass through the cut-outs (70) to form hand holes in the tray erected from the blank.

3. The one-piece blank of claim 1 wherein each post forming panel (72) is provided with a locking aperture (78) bounding on a hinge line joining it (72) to a respective auxiliary end forming panel (64), and wherein each primary end forming panel (26) is provided with a pair of hinged locking panels (38) at one end, each locking panel having a transversely extending locking tab (52), whereby when the blank is erected to form the tray, the locking panels fold over edges of the auxiliary end forming panels (64) and each locking tab (52) fits into a corresponding locking aperture (78) to hold the primary (26) and auxiliary (64) end forming panels together.

4. A tray, the tray being fashioned from a one-piece blank of stiff, resilient and foldable sheet material, such as paperboard, the tray having vertically extending, oppositely disposed side and end panels and a horizontally disposed, generally rectangular bottom panel, vertically disposed corner panels between the end and side panels to thereby define an octagonal tray, each end wall defined by two inner, coplanar auxiliary end panels which are in parallelism and surface contact with an outer, primary end panel, each inner end panel carrying a post forming panel, the latter being in surface contact with each other at each end of the tray to thereby define a double thickness, vertically disposed and inwardly extending post at each end of the tray, a straight lower edge of each corner panel extending to the bottomost surface of the bottom panel along a majority of the length of the edge, and wherein the bottom panel is slantingly cut at its corners and wherein one surface of a lower portion of each corner panel bears against the edge of a respective slanting cut of the bottom panel.

5. The tray of claim 4 including locking panels carried by an upper portion of each outer, primary end panel, each locking panel folded over an upper edge of a respective auxiliary end panel, each locking panel having a locking tab which fits into a corresponding locking aperture in a respective one of said post forming panels.

* * * * *